US006148633A

United States Patent [19]

Yamada et al.

[11] Patent Number: 6,148,633

[45] Date of Patent: Nov. 21, 2000

[54] FLOWING-DOWN ICE MAKING APPARATUS

[75] Inventors: Hatsuo Yamada; Tadashi Sakai; Sonoo Kato, all of Aichi-ken, Japan; Douglas Troy Steward, Newnan, Ga.

[73] Assignee: Hoshizaki Denki Kabushiki Kaisha, Aichi-ken, Japan

[21] Appl. No.: 09/217,204

[22] Filed: Dec. 22, 1998

[30] Foreign Application Priority Data

Dec. 25, 1997 [JP] Japan ..... 9-357481

[51] Int. Cl.[7] ..... F25C 1/12

[52] U.S. Cl. ..... 62/347; 62/348

[58] Field of Search ..... 62/73, 74, 347, 62/348, 352

[56] References Cited

U.S. PATENT DOCUMENTS

| | | | |
|---|---|---|---|
| 2,598,430 | 5/1952 | Pownall | 62/73 |
| 2,870,612 | 1/1959 | Garland | 62/348 |
| 3,430,452 | 3/1969 | Dedricks et al. | 62/347 |
| 4,199,956 | 4/1980 | Lunde | 62/352 |
| 4,505,130 | 3/1985 | Hibino et al. | 62/348 |
| 5,426,954 | 6/1995 | Furukawa | 62/352 |

OTHER PUBLICATIONS

New U.S. Patent Application filed Dec. 22, 1998, Hatsuo Yamada et al., entitled "Ice Making Apparatus".

*Primary Examiner*—William E. Tapolcai
*Attorney, Agent, or Firm*—Wenderoth, Lind & Ponack, L.L.P.

[57] ABSTRACT

An ice making apparatus is provided, in which an ice guide plate is capable of being fixed between an ice-water tank and ice-making plates without any fastener such as a screw. To realize such an arrangement, a convex portion (20) is formed on an inner surface of the bottom at the front end side of the ice-water tank (10), and the front end portion of the ice guide plate (19) is engaged therein so that a gap is formed between the convex portion (20) and a front wall portion of the ice-water tank (10). The rear end portion of the ice guide plate (19) is engaged with a groove 21 formed in a rear wall face 3*a* of the ice making chamber 3. As a result, the ice guide plate (19) can be fixed between the ice-water tank (10) and the ice-making plate.

9 Claims, 4 Drawing Sheets

FLOWING-DOWN ICE MAKING APPARATUS

BACKGROUND OF THE INVENTION

1. Field of the Invention

The present invention relates to a flowing-down ice making apparatus, in which ice water is allowed to flow down from an ice-water tank onto the surfaces of ice-making plates each arranged substantially vertically, to thereby produce ice. The ice may then be guided through the ice guide plate into an ice reservoir to be reserved therein. More specifically, the present invention relates to a supporting structure for the ice-water tank and the ice guide plate in the above-described ice making apparatus.

2. Description of the Related Art

Conventionally, this type of ice making apparatus generally includes a box-like main body having a thermally insulating structure for defining an ice making chamber that is integrally formed with an ice reservoir. The main body contains a pair of ice-making plates facing each other and sandwiching therebetween an evaporator formed of an evaporation tube. An ice-water tank is disposed below the ice-making plates, and an ice guide plate is disposed between the ice-water tank and the ice-making plates. The ice-making plates, evaporator, ice-water tank and ice guide plate are fixed to the main body. In operation, the ice released from the ice making surfaces of the ice-making plates is guided by the ice guide plate so that it passes over the front side of the ice-water tank into the ice reservoir to be reserved therein.

In the above ice making apparatus, however, the following problems have been encountered. A means for fixing the ice guide plate and the ice-water tank to the main body comprises fasteners such as screws, resulting in requiring a great number of fasteners. For that reason, attachment and/or detachment of the ice guide plate and the ice-water tank is time-consuming. In addition, when it is determined during attachment that a fixing area of the ice guide plate and/or the ice-water tank does not exactly mate with the area of the main body which is to receive the fasteners that are passed through the fixing area, many of the fasteners once fastened thereto must be released and again fastened.

SUMMARY OF THE INVENTION

Accordingly, the present invention has been made in view of the above, and an object of the present invention is to provide an ice making apparatus capable of easy attachment and/or detachment of an ice guide plate and/or an ice-water tank, realizing simple assembly and/or disassembly.

In order to achieve the above object, an ice making apparatus according to the present invention comprises: a main body having a thermally insulating structure for defining an ice making chamber; an ice-making component including at least one plate member provided vertically within the ice making chamber; an ice-water tank having its front end portion and rear end portion provided below the ice-making plate member; and an ice guide plate member formed between the ice-water tank and the ice-making plate member. The ice guide plate is arranged to be slanted in such a manner that its front end portion may be positioned lower than its rear end portion so as to guide ice to an ice reservoir of the ice making chamber. The apparatus is characterized in that a first engagement fixing component for the front end portion of the ice guide plate is formed at the front end portion of the ice-water tank, and a second engagement fixing component for the rear end portion of the ice guide plate is formed between the rear end portion of the ice guide plate and a wall portion of the main body receiving the rear portion of the ice guide plate.

In this ice making apparatus, it is preferable that the first engagement fixing component comprises a convex portion formed in a vicinity of the front end portion of the ice-water tank and on the inner surface of the bottom of the first engagement fixing component. A protrusion part is formed on the front end portion of the ice guide plate, and the protrusion part extends toward the front end portion of the ice-water tank so as to be brought into contact with the ice-water tank. The second engagement fixing component comprises a groove formed in the wall portion of the main body. The rear end portion of the ice guide plate is preferably inserted and fitted into this groove.

Further, the protrusion part of the first engagement fixing component comprises a plurality of protrusions formed so as to be spaced apart from each other in the width direction of the main body.

The ice-water tank is supported at the rear end portion thereof by a first supporting member attached to the main body from below, and the first supporting member extends forward from the rear portion within the ice making chamber. The ice-water tank is supported at the front end portion thereof from below by a beam-like second supporting member attached to the both sides of the main body, and the beam-like second supporting member extends widthwise across the ice making chamber.

The beam-like supporting member and the front end portion of the ice-water tank are coupled to each other only by a pair of fixing members. The pair of fixing members comprises a single tank bracket provided substantially at the central portion of the width direction of the front end portion of the ice-water tank, and a single screw screwed to the beam-like supporting member through the tank bracket.

The front end portion of the ice guide plate preferably has a plurality of end face portions apart from the inner surface of the bottom of the ice-water tank. Such an arrangement allows a gap to be formed between the end face portions and the inner surface of the bottom of the ice-water tank. The ice water entering the front end portion side of the ice-water tank runs through this gap and then through a gap between the convex portions formed on the inner surface of the bottom. Thus, the ice water flows smoothly toward the rear end portion side of the ice-water tank.

BRIEF DESCRIPTION OF THE DRAWINGS

A preferred embodiment of the present invention will now be described with reference to the accompanying drawings. It is noted that the same reference numerals are indicative of the same or corresponding portions throughout the drawings, wherein.

DETAILED DESCRIPTION OF THE PREFERRED EMBODIMENT

Although an embodiment of the present invention is explained in detail with reference to the accompanying drawings, as is clear from the following description, it is to be understood that the present invention is not limited thereto and various modifications may be applicable.

Figure 1:
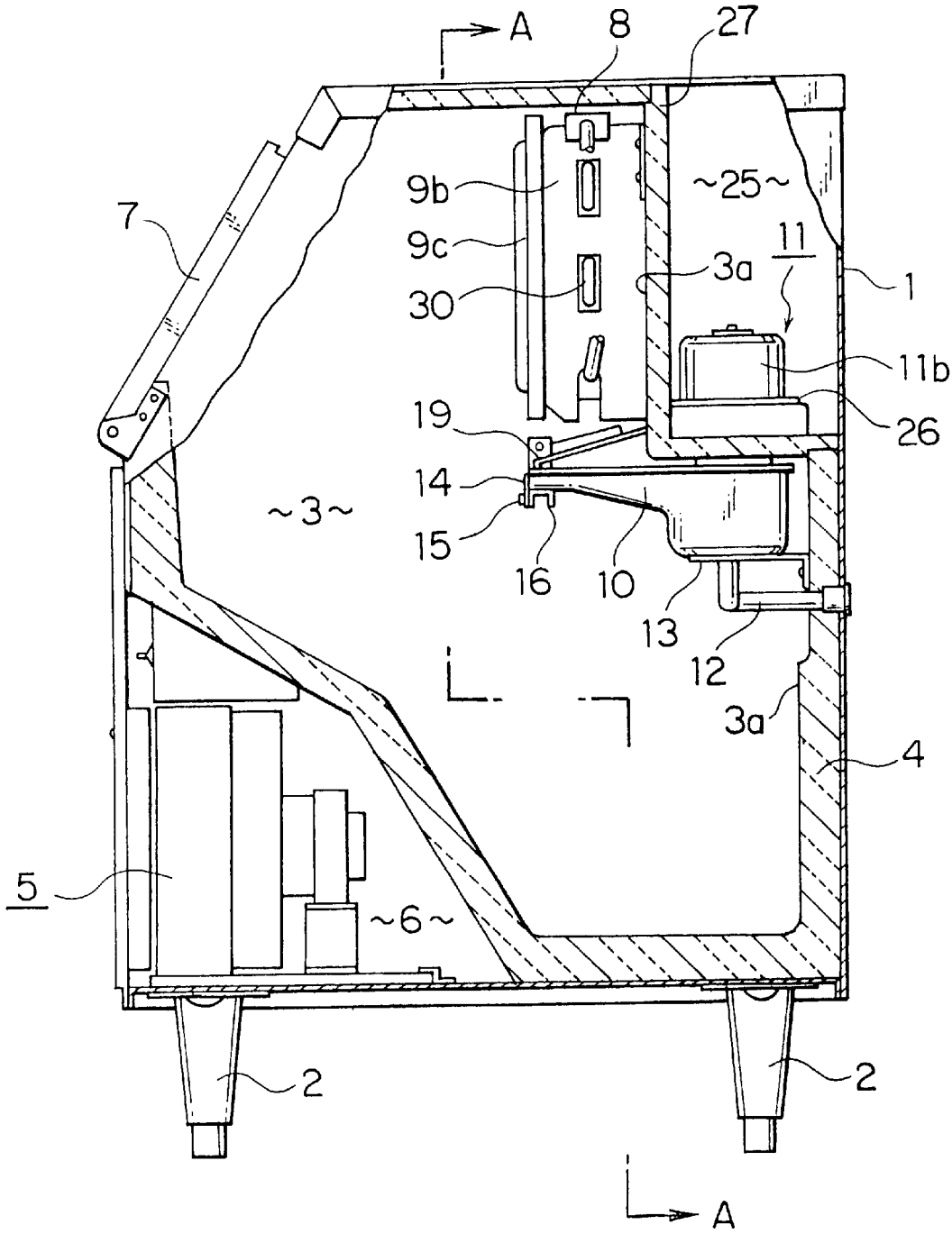
FIG. 1 is a vertically sectional view showing an ice making apparatus in accordance with an embodiment of the present invention.
Figure 2:
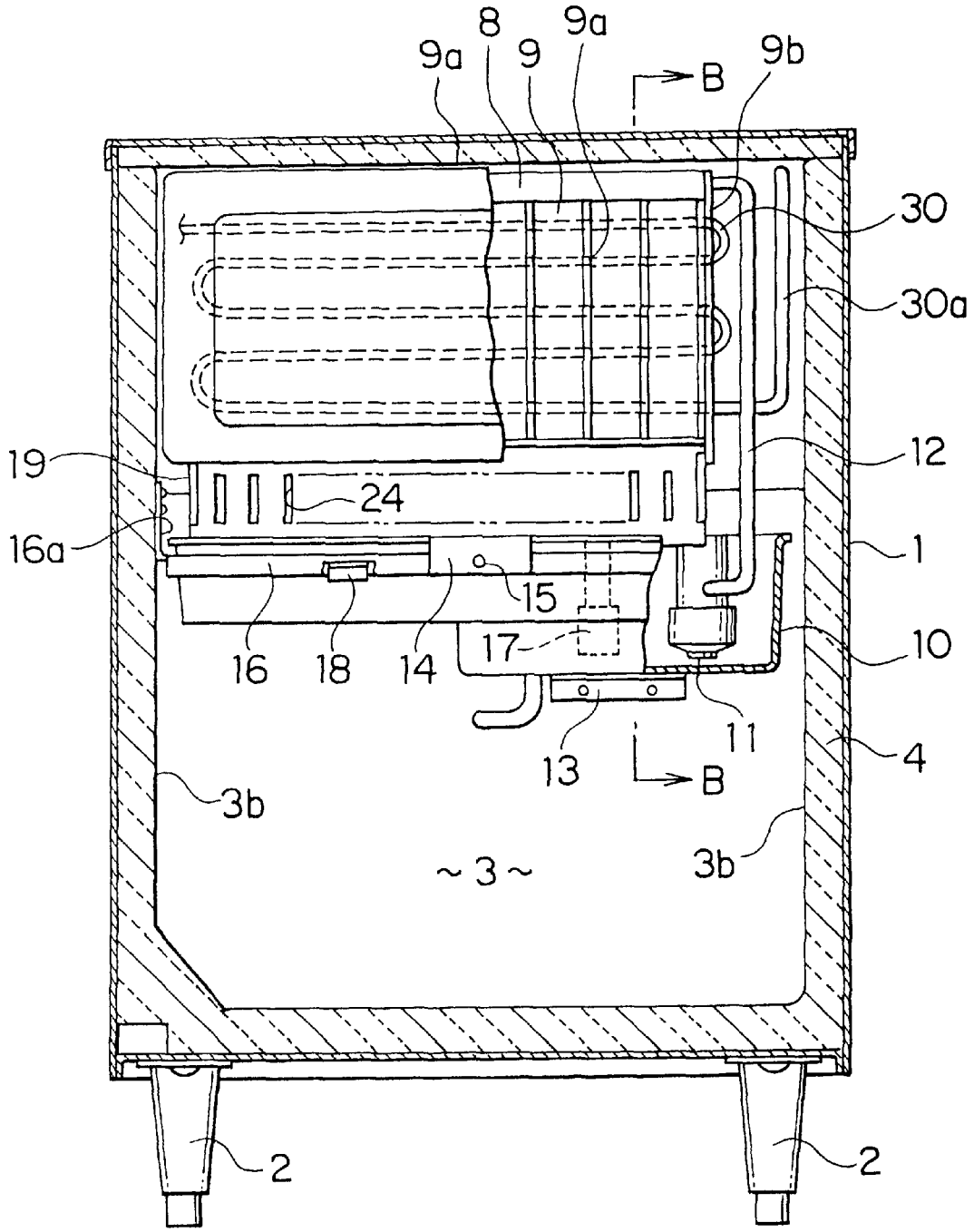
FIG. 2 is a sectional view taken along the line A—A of FIG. 1.

As shown in FIGS. 1 and 2, an ice making apparatus in accordance with an embodiment of the present invention comprises a main body 1 formed into a box shape having a thermally insulating structure, and a plurality of supporting legs 2 for supporting the main body 1 from below. The main body 1 defines an ice making chamber 3 formed integrally with an ice reservoir located at the lower side (hereinafter, simply referred to as "ice making chamber". This term "ice making chamber"includes the ice reservoir). The ice making chamber 3 is formed with a suitable thermally insulating material 4 therearound. Outside the ice making chamber 3, a lower machine chamber 6 for accommodating a known freezing unit 5, such as a compressor and a condenser, is formed at the front and lower portion of the ice making chamber 3 illustrated at the left-hand portion of FIG. 1. Incidentally, an ice ejection port is formed at the front and upper portion of the ice making chamber 3, and the ice ejection port can be opened and closed by an opening/closing lid 7 that is pivotably fixed to the main body 1.

The ice making chamber 3 contains therein a water sprinkler 8, a pair of ice-making plates 9 to which ice water is distributed or sprinkled from the water sprinkler 8, and an evaporation tube 30 disposed between these ice-making plates. The ice water distributed from the water sprinkler 8 flows down onto the surfaces of ice-making plates 9 to be reserved in an ice-water tank 10. The ice-water tank 10 shaped like the beak of a pelican, and placed below the ice-making plates 9. The ice-water tank 10 may be made of, for example, suitable synthetic resin. The ice water reserved in the ice-water tank 10 is designed to be circularly supplied to the water sprinkler 8 through a circulation pump 11 and a feed tube 12, which are described later.

In this embodiment, each ice-making plate 9 is formed of a stainless steel plate, and has on the ice-making (front) surface a plurality of protrusion fillets 9*a* extending vertically and spaced regularly apart from each other along the width direction. The ice water flows down between the protrusion fillets 9*a*. Further, the above-described evaporation tube 30, which is sandwiched between the ice-making plates 9 and is brought into contact with the reverse (back) surfaces of the ice-making plates (i.e., surfaces opposite the ice-making surfaces), extends across the protrusion fillets 9*a*. Accordingly, crescent ice can be produced between the protrusion fillets 9*a* on the respective ice-making surfaces at the areas opposite to the reverse surfaces contacted by the evaporation tube 30.

Each ice-making plate 9 is supported by a rigid supporting structure including side plates 9*b* formed at both ends thereof This supporting structure does not constitute a part of the present invention, and the detailed description thereof will be omitted. This supporting structure also supports a cover plate 9*c* that is provided over the front sides of the ice-making plates 9 for preventing the dropping ice water from scattering. The evaporation tube 30 is formed at an intermediate location of a refrigerant tube 30*a* leaving a refrigerant outlet of the compressor in the freezing unit 5 shown in FIG. 1 and returning to a refrigerant inlet of the compressor through the condenser and the like.

Figure 3:
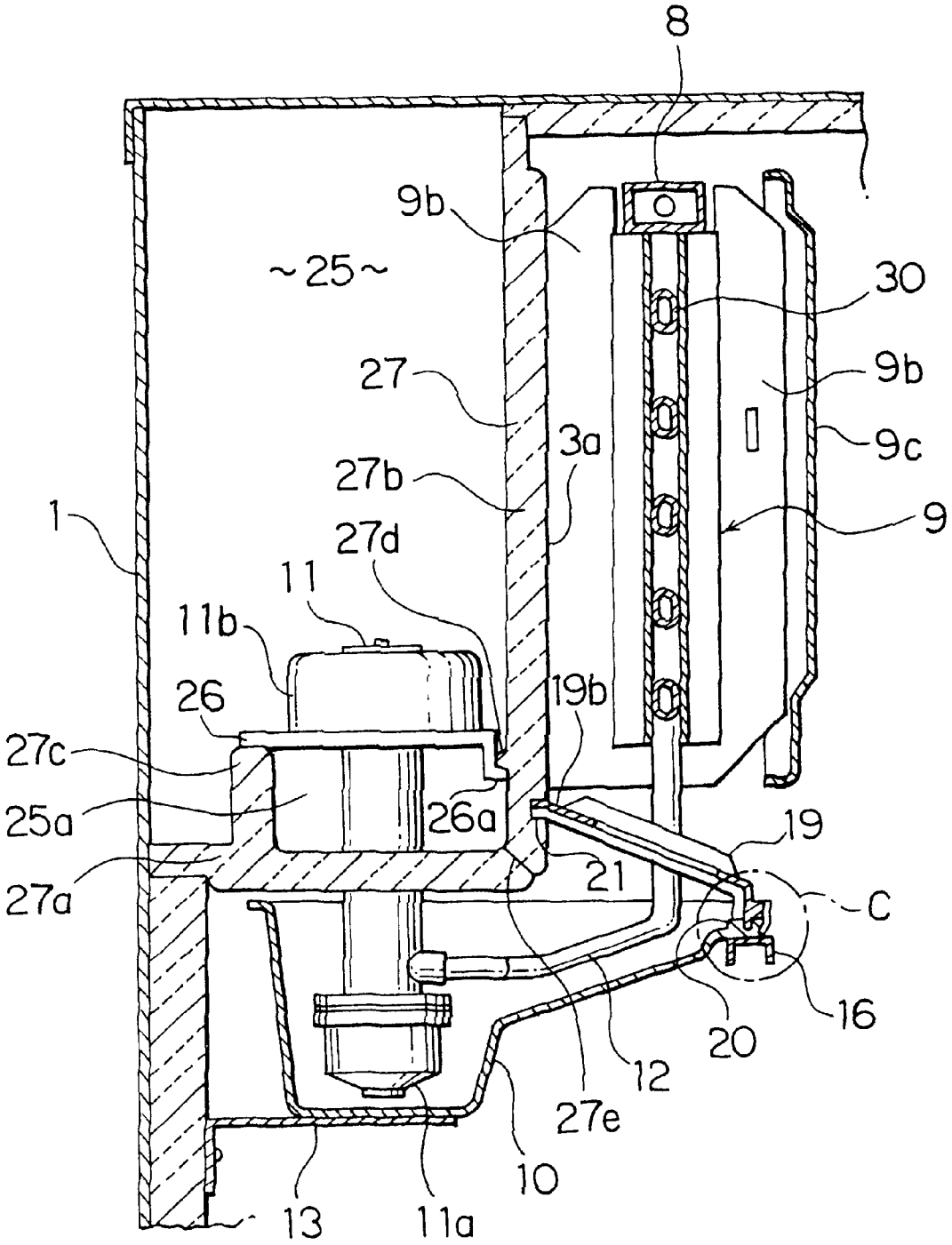
FIG. 3 is a sectional view taken along the line B—B of FIG. 2.

As shown in FIGS. 1 and 3, a supporting member 13 is provided at the rear portion of the ice making chamber 3 in a shelf-like manner (see the right-hand portion in FIG. 1), which supports from below the ice-water tank 10 at about the rear half portion of the bottom of the tank. The supporting member 13 is formed by, for example, bending a metal plate into an L shape, and attached the plate onto a rear wall face 3*a* of the internal box in the main body 1 by a fixing means such as a plurality of screws.

At a nearly central portion of the ice making chamber 3, a beam-like supporting member 16 for supporting the front end portion of the ice-water tank 10 from below is disposed in a substantially horizontal manner. As shown in FIG. 2, both end portions 16*a*, 16*a* of the supporting member 16 extend widthwise across the ice making chamber 3 and are fixed onto opposing side wall faces 3*b*, 3*b* of the ice making chamber 3 by fixing parts such as a plurality of screws (only one fixing part is shown in this figure). A tank bracket 14 provided at the front end central portion of the ice-water tank 10 is detachably fixed to the central portion of the supporting member 16 by a screw 15 having a head suitably dimensioned to be held by hand. Further, the supporting member 16 is provided with a known ice reservoir detection sensor 18 (see FIG. 2) such as a thermostat. Ice accumulating within the ice reservoir increases during operation, and when the increment comes into contact with the ice reservoir detection sensor 18 that is electrically connected to an operation control circuit (not shown), the ice making operation can be automatically stopped.

As shown in FIG. 3, the circulation pump 11 is provided with a motor portion 11*b* for driving a pump portion 11*a*. The motor portion 11*b* is accommodated in an upper machine chamber 25 formed at the rear upper portion outside the ice making chamber 3 in the main body 1. The upper machine chamber 25 is defined by a thermally insulating panel 27 formed into substantially an L shape as a whole and an external box part of the main body 1. On a horizontal bottom 27*a* of the panel 27 is formed a vertical side wall 27*c* having a U-shape configuration which defines a space 25*a* in cooperation with a vertical leg portion 27*b* of the panel 27. As illustrated in FIG. 3, a bracket 26 is positioned over the U-shaped upper end face of vertical side wall 27*c*. It is noted that the thermally insulating panel 27 is substantially plate-like as a whole prior to assembling the main body, but once assembled, is bent at a bent concavity 27*e* (FIG. 3). As a result, it is formed into substantially an L shape as is illustrated in FIG. 3.

The bracket 26 has a tip end formed into substantially an L shape at the side of the vertical leg portion 27*b* of the thermally insulating panel 27, to which a rigidity sufficient to support the motor portion 11*b is* given. This L-shaped tip end 26*b* of the bracket 26 is inserted under a convex fillet 27*d*formed on the surface of the upper machine chamber side of the panel vertical leg portion 27*b*. The circulation pump 1 and a float switch 17 (see FIG. 2) are fixedly supported by the bracket 26. An output shaft of the motor portion 11*b* of the circulation pump 11 passes through the above-noted bracket 26, space 25*a* and horizontal bottom 27*a* of the panel 27, and extends downward so that it may communicate with the pump portion 11 a located within the ice-water tank 10. The float switch 17 detects the minimum water level of the ice water within the ice-water tank 10. The float switch 17 is connected to an operation control circuit (not shown) of the ice maker so that when the minimum water level of the ice water within the ice-water tank 10 is detected by the float switch 17, the operation of the circulation pump 11 can be automatically stopped to prevent the water from feeding to the water sprinkler 8.

Figure 4:
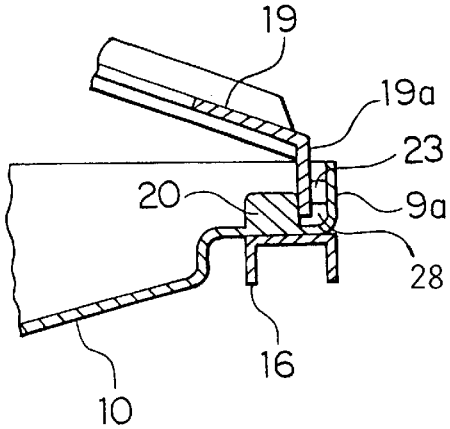
FIG. 4 is an enlarged view showing the part C of FIG. 3.

FIG. 3 is a sectional view taken along the line B—B of FIG. 2, and FIG. 4 is an enlarged view showing a part C of FIG. 3. As shown in FIG. 3, an ice guide plate 19 for guiding the ice released from the surfaces of the ice-making plates 9 forward beyond the ice-water tank 10 is formed between the ice-water tank 10 and the ice-making plates 9. A front end portion 19*a* (see FIG. 4) of the ice guide plate 19 is engaged and fixed between a convex portion 20 (see FIG. 4) formed on the bottom face of the ice-water tank 10 and a front wall portion 10*a* of the ice-water tank 10, as is described later.

Figure 5:
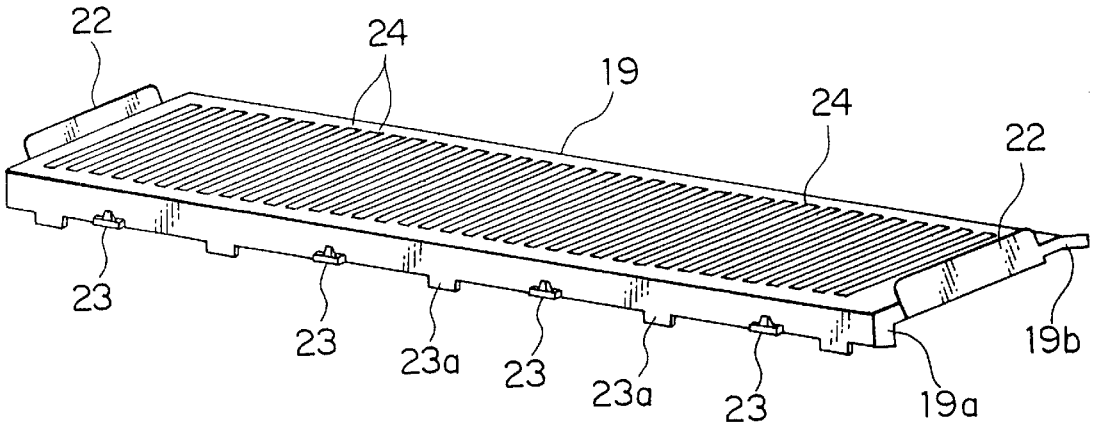
FIG. 5 is a perspective view showing an ice guide plate according to the present invention.

The thickness of the front end portion 19*a* itself is considerably smaller than the gap formed between the above-noted convex portion 20 and the front wall portion 10*a* of the ice-water tank 10. However, as is best shown in FIG. 5, the front end portion 19*a* is provided with a plurality of protrusions 23 longitudinally spaced apart from each other so as to abut against the front wall portion or the front wall portion 10*a* of tank 10. For this reason, the front end portion 19*a* having the protrusions 23 is inserted into the gap formed between the above-described convex portion 20 and the front wall portion 10*a* of the ice-water tank 10, with the result that it can be engaged and fixed between the convex portion 20 and the front wall portion 10*a*. On the other hand, the rear end portion 19*b* of the ice guide plate 19 is in fixed engagement with a groove 21 (see FIG. 3) formed in the wall surface 3*a* of the vertical leg portion 27b of the thermally insulating panel 27.

FIG. 5 is a perspective view showing the ice guide plate 19. As shown in this figure, guide walls 22, 22 are formed at both sides of the ice guide plate 19 so as to upstand (extend upwardly) therefrom. These guide walls are designed to prevent the ice that drops down onto the upper surface of the ice guide plate 19 from falling down from the side portions of the ice guide plate 19. According to the embodiment of the present invention, the ice guide plate 19 is formed of synthetic resin, such that the ice water flowing down onto the surfaces of the ice-making plates 9 runs through slits 24 (see FIG. 5) apertured in the ice guide plate 19 so as to be collected in the ice-water tank 10.

As described above, according to the embodiment of the present invention, the front end portion 19*a* of the ice guide plate 19 is engaged and fixed between the convex portion 20 formed on the bottom of the ice-water tank 10 and the front wall portion 10*a* of the ice-water tank 10. The rear end portion 19*b* of the ice guide plate 19 is engaged and fixed to the groove 21 formed in the wall surface 3*a* behind the thermally insulating panel 27 defining the ice making chamber 3. As a result, the ice guide plate 19 can be fixed between the ice-water tank 10 and the ice-making plates 9 without any fastener such as a screw. Accordingly, the number of parts can be greatly reduced, and easy attachment and/or detachment of an ice guide plate 19 may be possible. This results in realizing a simple assembly and/or disassembly operation of the ice making apparatus.

Further, in the foregoing embodiment, the plurality of protrusions 23 abutting against the front wall portion 10*a* of the ice-water tank 10 at the interior of the tank 10 are provided on the front end portion 19*a* of the ice guide plate 19 so as to be spaced apart from each other in the width direction of the ice-water tank 10. Therefore, the space 28 serving to collect the ice water dropping from the front end portion 19*a* of the ice guide plate 19 in the main portion of the ice-water tank 10 may be formed between the front wall 10*a* of the ice-water tank 10 and the front end portion 19*a* of the ice guide plate 19. With this arrangement, the ice water entering the front end side of the ice-water tank 10 can be prevented from overflowing and from dropping into the ice making chamber 3. Further, it is appreciated that the front end portion 19*a* of the ice guide plate 19 is also formed with a plurality of bottom protrusions 23*a* at the lower edge thereof which are longitudinally spaced apart from each other. Thus, a gap is formed for collecting the ice water between the protrusions 23*a* and the bottom surface of the ice-water tank 10. Incidentally, in this embodiment, although the plurality of convex portions 20 are formed on the inner surface of the bottom of the ice-water tank 10 so as to be spaced apart from each other in the width direction of the ice-water tank 10, only one convex portion may be formed widthwise. In this case, the front end lower surface that defines the concave portions formed between the protrusions 23*a* that are formed on the front end portion 19*a* of the ice guide plate 19 must be positioned above the upper surface of the convex portion 20. Therefore, the ice water entering the front end side of the ice-water tank 10 can smoothly flow toward the rear end side.

Furthermore, according to the above-described embodiment of the invention, the supporting member 16 for supporting the front end portion 10*a* of the ice-water tank 10 from below is formed of metal such as stainless steel. When the ice reserved in the ice making chamber 3 ( i.e., the reservoir) is removed therefrom, an ice removal scoop may strike the supporting member 16 rather than the ice-water tank 10. Therefore, the ice-water tank 10 made of synthetic resin, as described above, can be prevented from being broken.

Still further, the ice dropping down from the front end portion of the ice guide plate 19 may be accumulated in a conical or chevron form on the bottom of the ice making chamber 3. In this embodiment, the ice-water tank 10 is so arranged as to be more shallow at the front and deeper at the rear. Therefore, the configuration of the bottom surface of the ice-water tank 10 substantially follows that of the accumulated ice in the form of a mountain. As a result, more ice can be reserved in the ice making chamber 3.

Still further, the tank bracket 14 (see FIG. 2) formed at the front end portion 10*a* of the ice-water tank 10 is screwed to the supporting member 16 fixed to the side wall of the ice making chamber 3 by the single attachment screw 15 for the ice-water tank 10, as described above. With such a simple arrangement, once the single attachment screw 15 for the ice-water tank 10 is removed, the ice-water tank 10 can be drawn out forward within the ice making chamber 3. Accordingly, water deposit and the like that are affixed to the ice-water tank 10 may be readily removed by detaching the ice-water tank 10 from the ice making chamber 3.

As described above, according to the present invention, while the ice water flowing down onto the ice making surfaces of the ice-making plates does not drop into the ice making chamber from the front end portion of the ice-water tank, the ice guide plate can be fixed between the ice-water tank and the ice-making plates without any fastener such as a screw. In addition, attachment and/or detachment of the ice-water tank can be easily realized.

Various details of the present invention may be changed without departing from its spirit nor its scope. Furthermore, the foregoing description of the embodiments according to the present invention is provided for the purpose of illustration only, and not for the purpose of limiting the present invention as defined by the appended claims and their equivalents.

What is claimed is:

1. An apparatus comprising:

a main body comprising insulating material and including an ice making chamber having an ice reservoir;

an ice making component including at least one ice making plate arranged vertically within said ice making chamber;

a water tank arranged below said ice making component and including a front portion, a rear portion, and a bottom portion having an inner surface;

an ice guide plate having a front portion and a rear portion and being arranged at an angle between said ice making component and said water tank such that said front portion of said ice guide plate is lower than said rear portion of said ice guide plate so as to guide ice formed by said ice making component into said ice reservoir;

a first engagement fixing component for holding said front portion of said ice guide plate, said first engagement fixing component including a convex portion formed at said front portion of said water tank on said inner surface of said bottom portion of said water tank, and including a protrusion part formed on said front portion of said ice guide plate and extending outward so as to be in contact with said front portion of said water tank; and a second engagement fixing component for holding said rear portion of said ice guide plate, said second engagement fixing component being formed between a wall of said main body and said rear portion of said ice guide plate.

2. The apparatus of claim 1, wherein said second engagement fixing component comprises a groove formed in said wall of said main body.

3. The apparatus of claim 1, wherein said protrusion part comprises a plurality of protrusions spaced apart from each other along said front portion of said ice guide plate.

4. The apparatus of claim 3, further comprising a plurality of bottom protrusions extending downward from said front portion of said ice guide plate to be in contact with said inner surface of said bottom portion of said water tank so as to form a gap between said front portion of said ice guide plate and said bottom portion of said water tank.

5. The apparatus of claim 1, further comprising a first supporting member attached to said main body for supporting said rear portion of said water tank from below, and a second supporting member for supporting said front portion of said water tank from below, said first supporting member extending forward from said rear portion of said water tank within said ice making chamber, said second supporting member having a beam-like shape and extending widthwise across said ice making chamber.

6. The apparatus of claim 5, wherein said second supporting member and said front portion of said water tank are connected by a pair of fixing members.

7. The apparatus of claim 6, wherein said pair of fixing members comprises a single tank bracket at a substantially central part of said front portion of said water tank, and a single screw threaded into said second supporting member through said tank bracket.

8. The apparatus of claim 1, wherein said front portion of said water tank includes a front wall, said convex portion extending in a widthwise direction parallel to said front wall of said water tank so as to form a gap between said convex portion and said front wall.

9. The apparatus of claim 8, wherein said protrusion part comprises a plurality of protrusions spaced apart from each other along said front portion of said ice guide plate, said front portion of said ice guide plate being inserted into said gap such that said plurality of protrusions contact said front wall of said water tank.

* * * * *